United States Patent [19]

Broach

[11] Patent Number: 4,463,412

[45] Date of Patent: Jul. 31, 1984

[54] ILLUMINATED SHOE SKATE ATTACHMENT

[76] Inventor: Ronald W. Broach, 5418 Reading Rd., Cincinnati, Ohio 45237

[21] Appl. No.: 344,550

[22] Filed: Feb. 1, 1982

[51] Int. Cl.[3] ..... A63C 17/26

[52] U.S. Cl. ..... 362/61; 36/137; 280/811; 280/816; 362/103; 362/190

[58] Field of Search ..... 280/809, 811, 816, 825; 36/137; 362/184, 188, 103, 61, 190; 200/311, 317

[56] References Cited

U.S. PATENT DOCUMENTS

| | | | |
|---|---|---|---|
| 1,460,149 | 6/1923 | Barany | 362/184 |
| 2,140,224 | 12/1938 | Galgoczy | 280/816 |
| 2,502,566 | 4/1950 | Hooley | 280/816 |
| 2,505,154 | 4/1950 | Smith | 280/819 |
| 2,531,959 | 11/1950 | Woodard | 280/816 |
| 2,572,760 | 10/1951 | Rikelman | 362/103 |
| 2,931,012 | 3/1960 | Kosach | 280/819 |
| 3,946,505 | 3/1976 | Dana | 36/36 R |
| 4,240,132 | 12/1980 | Wickman | 280/816 |
| 4,367,515 | 1/1983 | Beard | 362/103 |

FOREIGN PATENT DOCUMENTS

| | | | |
|---|---|---|---|
| 2715100 | 10/1978 | Fed. Rep. of Germany | 36/137 |

*Primary Examiner*—Joseph F. Peters, Jr.
*Assistant Examiner*—Michael Mar
*Attorney, Agent, or Firm*—Frost & Jacobs

[57] ABSTRACT

A bracket assembly for illuminating shoe skates, such as roller skates or ice skates, the bracket assembly comprising one or more bracket units adapted to be detachably secured to the skate, the bracket units selectively containing fittings for mounting light sources, such as multicolored miniature light bulbs, a source of electrical current for the light sources, and switch means for selectively actuating and deactuating the light sources.

9 Claims, 13 Drawing Figures

ILLUMINATED SHOE SKATE ATTACHMENT

This invention relates to the illumination of shoe skates, such as roller skates or ice skates, so as to provide visual imagery to the observer. More particularly, the present invention relates to the illumination of shoe skates by means of one or more bracket units which may be readily attached to and detached from the skates, the units containing lights, control circuitry, and a power source.

BACKGROUND OF THE INVENTION

Skating has developed into a popular hobby and a prosperous profession. Numerous individuals use roller skating and ice skating as a means of exercise, entertainment, and enjoyment. To enhance the visual imagery created by skating, it has hitherto been proposed to illuminate skates by means of small electric light bulbs arranged to produce desired lighting effects. The illuminating devices which have hitherto been proposed have been either permanently attached to the skates or have required structural changes in the skates. If the skater wishes to skate without the illuminating devices, he is unable to do so since the devices have been permanently affixed to the skate and their removal will disfigure the skates. Likewise, if the skater wishes to use the illuminating devices on another pair of skates, he is also unable to do so.

Various devices have also been proposed to illuminate shoe heels and soles, especially when the shoes are used for dancing. U.S. Pat. No. 4,158,922 to Dana III discloses a flashing disco shoe controlled by a three-way switch device which varies the illumination of the lights contained within the shoe. The shoe must be made from a transparent material to allow the illuminating devices to be seen. Such shoes are permanently altered by the illuminating devices and the devices cannot be used interchangeably with other pairs of shoes. Similarly, U.S. Pat. Nos. 3,946,505 and 3,893,247 teach the implantation of light bulbs within transparent heels and soles. U.S. Pat. No. 4,020,572 requires a transparent chamber on the shoe sole in which a light is mounted.

The present invention obviates the disadvantage inherent in the foregoing types of illuminated shoes by providing an assembly which may be detachably secured to conventional shoe skates to convert them into illuminated skates.

SUMMARY OF THE INVENTION

The present invention comprises an attachment for shoe skates in the form of a bracket assembly which may be detachably secured to conventional shoe skates, the bracket assembly including light sources, a power source electrically connected by circuitry to the light sources, and switches for controlling the flow of electricity from the power source to the light sources, together with means for attaching the bracket assembly to the skates.

The bracket assembly comprises one or more bracket units which may be used individually or in combination so as to alter the pattern of illumination. Thus, the assembly may include a toe bracket unit adapted to be positioned around the toe of the skate, a lower bracket unit adapted to be mounted on the skate frame beneath the skate shoe, a rear bracket unit at the rear of the skate, and a heel bracket unit which may be fitted between the skate frame and the sole of the skate shoe adjacent the heel. Other optional bracket units also may be used.

The light sources, which preferably comprise miniature light bulbs of various colors, are positioned in apertures formed in the bracket units, being connected by suitable circuitry to a power source comprising one or more batteries, the circuitry including switches for selectively energizing and deenergizing selected light sources.

The bracket units are attached to the skate frame by providing slots in the brackets which engage with the bolts or rivets utilized to mount the skate frame to the shoe, or by providing flanges on the brackets which engage the ridges of the skate frame.

Thus, it is a principal object of the invention to provide a shoe skate attachment which can be readily attached to and removed from a shoe skate with a minimum of effort.

It is a further object of the present invention to provide an illuminated shoe skate attachment comprising one or more bracket units which may be attached to selected portions of the shoe skate so that the wearer can select various patterns of visual imagery.

Still a further object of the invention is the provision of a variety of shoe skate attachments which can be used interchangeably on different sizes and shapes of shoe skates, and which do not require modification or alteration of the skates except in the event a special effect, such as an illuminated heel, is desired.

DESCRIPTION OF THE PREFERRED EMBODIMENTS

Figure 1:
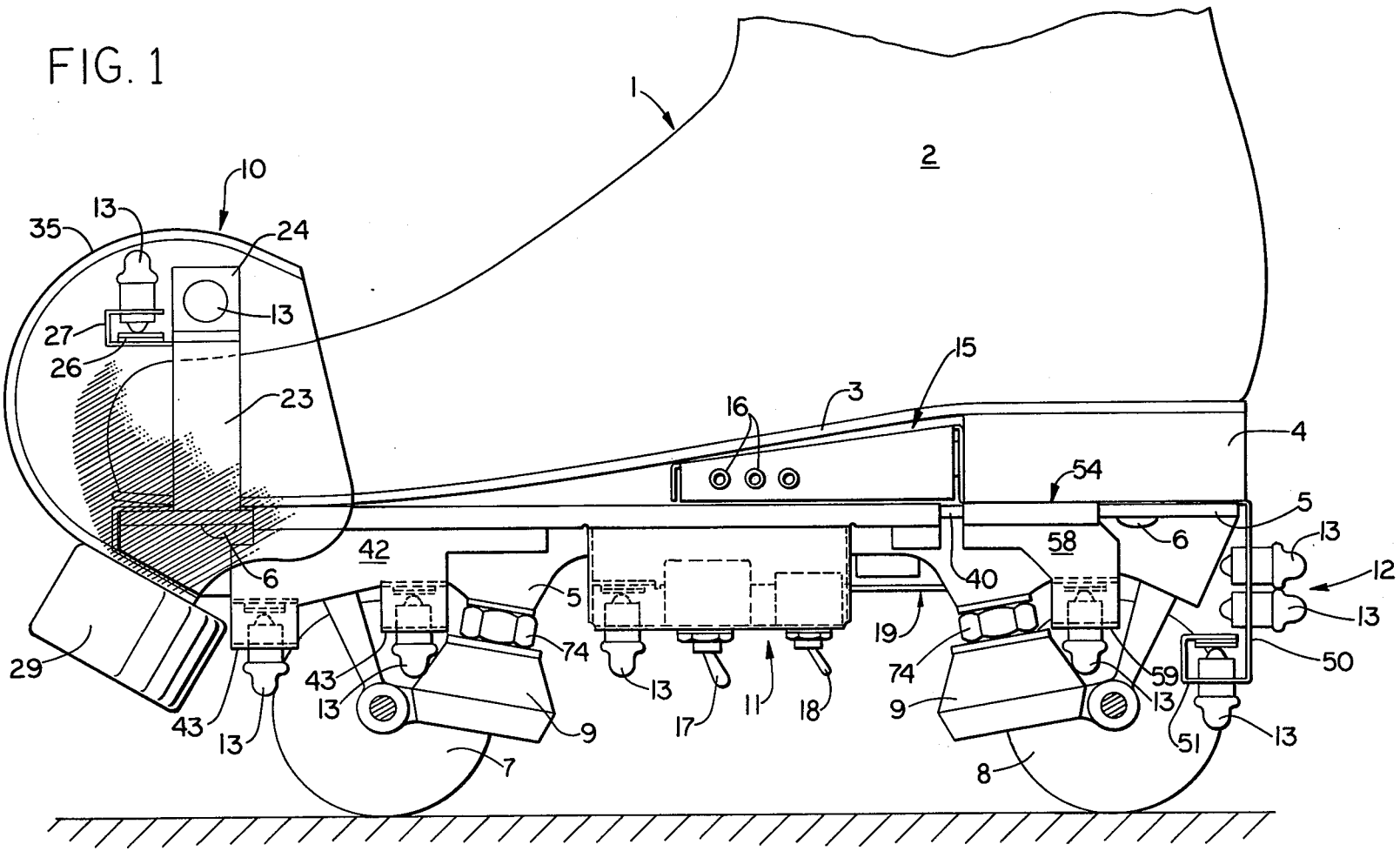
FIG. 1 is a side elevational view of a shoe skate incorporating a series of bracket units in accordance with the invention.
Figure 2:
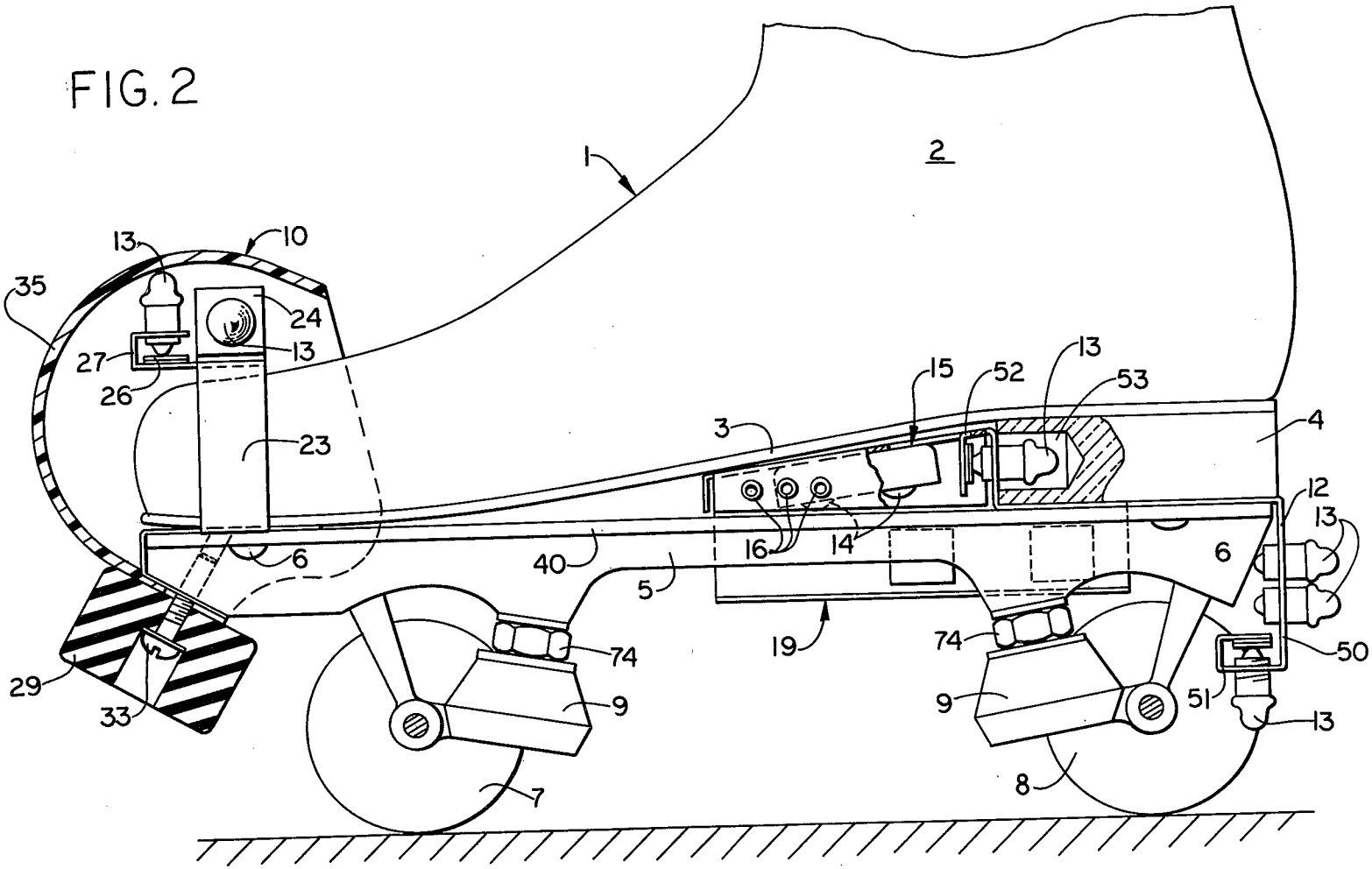
FIG. 2 is a side elevational view similar to FIG. 1 but which parts broken away illustrating additional details of the toe bracket and the use of the heel bracket unit to illuminate a transparent heel.

Referring first to FIGS. 1 and 2 of the drawings, a shoe skate is indicated generally by the reference numeral 1, the skate comprising a shoe 2 having a sole 3 and a heel 4, all of conventional shoe skate construction. In the embodiment illustrated, a skate frame 5 is secured at its opposite ends to the sole and heel of the shoe, respectively, by means of rivets or bolts 6. In the embodiment illustrated, the skate frame 5 mounts sets of front wheels 7 and rear wheels 8, together with conventional cushioning means 9. While a roller skate is illustrated, it will be understood that other types of skates, such as ice skates, are within the scope of the invention.

In the embodiment illustrated in FIG. 1, a toe bracket unit 10 surrounds and projects upwardly from the toe of the shoe skate, and a lower bracket unit 11 is mounted beneath the frame 5 between the front wheels 7 and rear wheels 8. A rear bracket unit 12 is mounted on the rear of the skate frame 5 beneath shoe heel 4. These basic bracket units will be considered first, although it will be understood that various additional brackets units may be utilized depending upon the effects desired. Common to the bracket units are light sources 13, which preferably comprise miniature light bulbs of various colors adapted to be energized by one or more batteries 14 contained in a housing 15 of a size to be fitted between the frame 5 and the shoe sole 3 adjacent the heel 4. The housing 15 may be provided with power outlets 16 for supplying current to the light sources associated with the various bracket units. While the various light sources 13 may be connected directly to the power source, it is preferred to provide switches for such purpose. In the embodiment illustrated, power switches 17 and 18 are incorporated in the lower bracket unit 11, although a switch bracket unit 19 may be utilized to mount switches 20 and 21 alone or in conjunction with the switches 17 and 18 to control selected light sources, thereby enabling the skater to create various light patterns.

The various bracket units are preferably formed from sheet metal, although other materials, such as plastic, may be used. However, if the bracket units are formed from an electrically conductive material, the cost of the units may be greatly reduced in that the brackets may serve as the ground for the various light sources in that all of the bracket units are connected to the skate frame 5 which forms a common ground.

Figure 6:
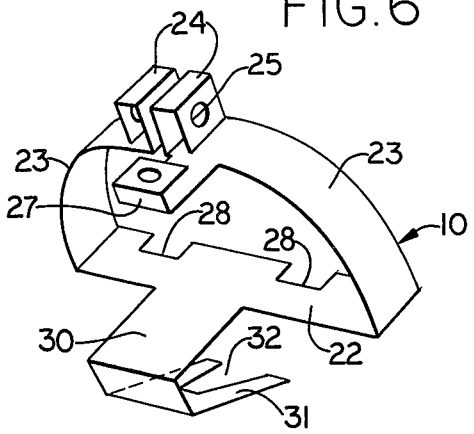
FIG. 6 is a perspective view of a toe bracket unit.

A preferred form of toe bracket is seen in FIG. 6, the design of the bracket being such that it can be formed from a single piece of metal, the bracket having a base 22, an upwardly projecting pair of inwardly curved arms 23 which terminate in U-shaped fittings 24 having apertures 25 in their outermost legs. The apertures 25 are of a size to enter into threaded engagement with the threaded sockets of miniature light bulbs thus eliminating the necessity for separate sockets. In this connection, it will be understood that the opposite legs of the fittings 24 will be provided with insulated contacts which will be connected, through suitable wiring, to the positive side of the power source. Such insulated contacts are seen at 26 in FIGS. 1 and 2.

The bracket unit 10 may be provided with additional light source fittings extending along the arms 23, one such additional fitting 27 being seen in FIG. 6. The base 22 is provided with slots 28 adapted to engage the rivets or bolts 6 when the base 22 is inserted between the front edge of the sole 3 of the shoe skate and the leading edge of the skate bracket 5, as will be apparent from FIG. 2. Since most roller skates are equipped with a toe stop 29, the toe bracket may include an extension 30 with a downwardly and rearwardly projecting arm 31 having a slot 32, the arm being engagable between the toe stop 29 and the adjoining surface of skate frame 5, the toe stop 29 and bolt 33 being loosened to permit the arms 32 to be inserted.

Figure 5:
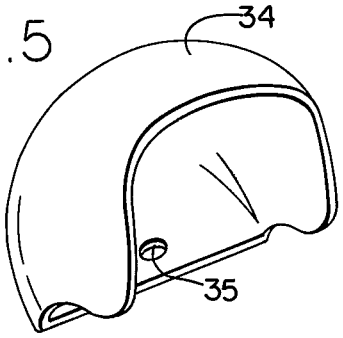
FIG. 5 is a perspective view of a toe coverture.

A molded toe coverture 34, seen in FIG. 5, may be provided to enhance the light source display, the coverture having an opening 35 therein by means of which it may be attached to the skate frame 5 utilizing the bolt 33 for the toe stop, as will be evident from FIG. 2. The coverture may be molded from various plastic materials, such as acrylic resin, and may be transparent or translucent.

Figure 3:
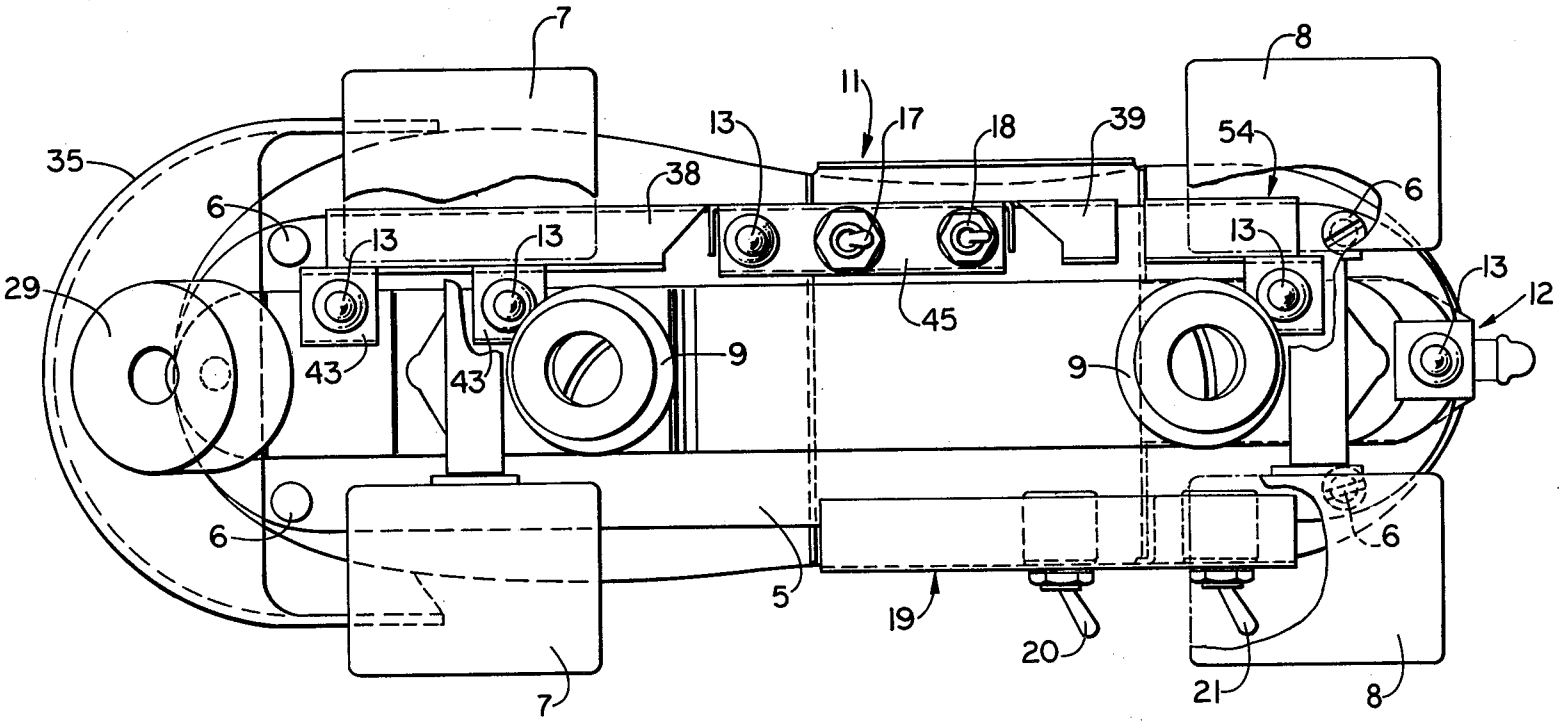
FIG. 3 is a bottom plan view illustrating the shoe skate of FIG. 1.
Figure 4:
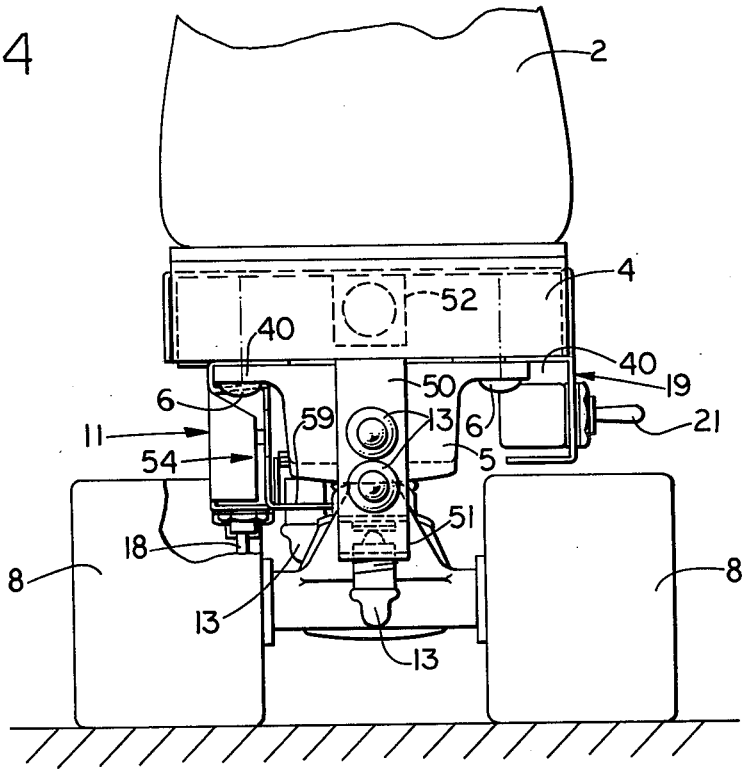
FIG. 4 is a rear plan view illustrating the shoe skate of FIG. 1.
Figure 7:
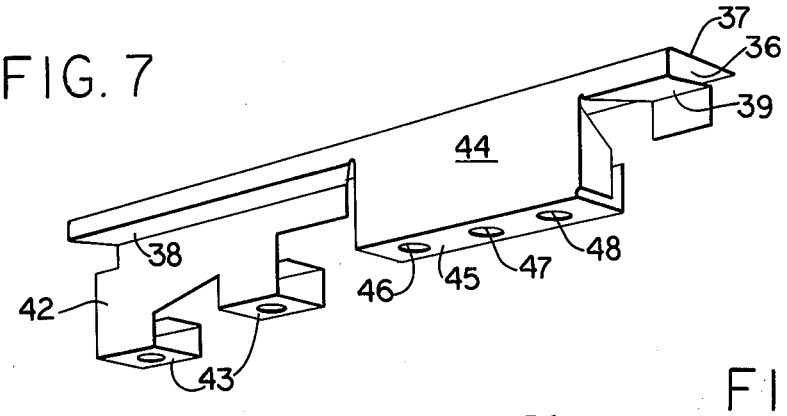
FIG. 7 is a perspective view of a lower bracket unit.

The lower bracket unit 11 may take the form shown in FIG. 7, the bracket having a elongated channel 36 defined by an upper flange 37 and lower flanges 38 and 39 adapted to engage about a longitudinal side edge 40 of the skate frame 5, the channel being configured so that it will enter into clamping engagement with the side edge 40 of the skate frame 5. In the embodiment illustrated, the bracket unit 11 has a forward depending member 42 mounting a plurality of U-shaped fittings 43 similar to the fittings 24 of the toe bracket in which light sources may be mounted. The bracket unit also has a rear depending member 44 having a bottom wall 45 provided with an aperture 46 for an additional light source and apertures 47 and 48 for mounting the power switches 17 and 18 seen in FIGS. 1 and 3. It will be understood that conventional electric wiring will be utilized to interconnect the various light sources 13 to the control switches 17 and 18 which, in turn, are connected to the power source.

Figure 8:
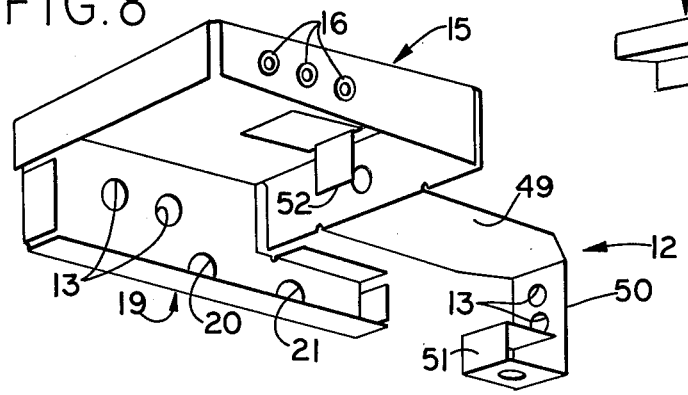
FIG. 8 is a perspective view of a rear bracket unit integrally formed with a heel unit and a switch unit.

The rear bracket unit 12 is seen in FIG. 8. In its simplest form, it comprises an attachment plate 49 having a depending arm 50 mounted a U-shaped fixture 51 adapted to receive one or more light sources. The attachment plate 49 is adapted to be inserted between the shoe heel 4 and the rear portion of the skate frame 5. To this end, it may be provided with slots similar to the slots 28 seen in FIG. 6 which will engage the rivets or bolts 6 which secure the skate frame to the shoe heel. In the embodiment illustrated in FIG. 8, the rear bracket unit is integrally formed with the battery housing 15 which, in turn, may be provided with additional illuminating devices, such as a socket-like fitting 52 which, as seen in FIG. 2, may be provided with a light source 13 adapted to be received in the cavity 53 in the shoe heel 4 which, in such instance, will be formed from a translucent or transparent material. In addition, the switch bracket 19 may be formed as an integral part of the bracket unit. Light sources 13 may be positioned along the depending arm 50 and the switch bracket unit 19.

Figure 9:
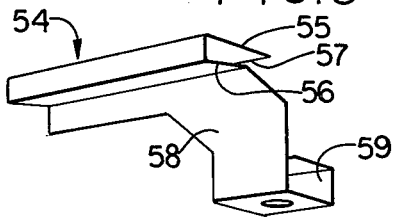
FIG. 9 is a perspective view of a variation of a lower bracket unit.

Various additional or optional bracket units also may be provided. For example, as seen in FIGS. 1 and 9, the bracket unit 54 is adapted to be clamped to a side edge 40 of the skate frame 5 at any desired location, the bracket unit having a pair of flange members 55 and 56 defining a channel 57, the unit including a depending member 58 mounting a U-shaped fitting 59 adapted to receive a light source.

Figure 10:
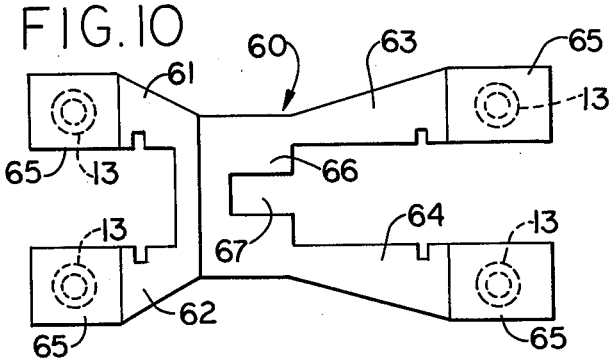
FIG. 10 is a top plan view of an extension bracket unit.
Figure 11:
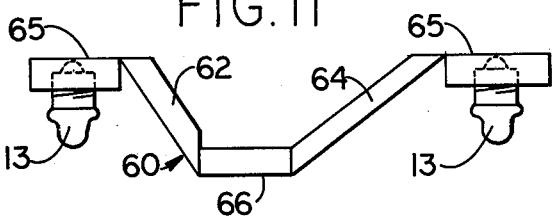
FIG. 11 is a side elevation of the extension bracket of FIG. 10.

A modified bracket unit is seen in FIGS. 10 and 11. In this instance, the bracket unit is configured to provide extensions 61, 62, 63 and 64 having light source fittings 65 at their outermost ends. The center plate 66 is provided with a slot 74 by means of which the bracket may be engaged with the action nuts 74 of cushioning means 9, the arrangement being such that pairs of the light sources will straddle the skate frame and project forwardly and rearwardly of a given pair of wheels.

Figure 12:
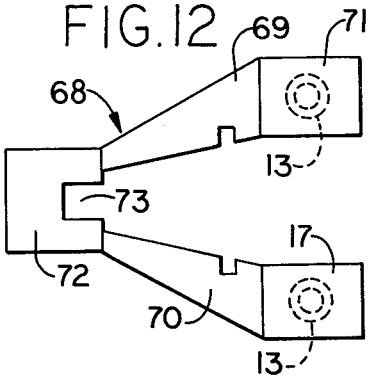
FIG. 12 is a top plan view of a modified form of an extension bracket unit.
Figure 13:
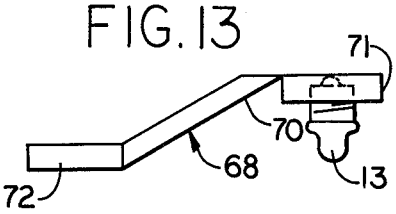
FIG. 13 is a side elevation of the modified extension bracket of FIG. 12.

In the embodiment of FIGS. 12 and 13, the bracket unit 68 comprises a single pair of extensions 69 and 70 each mounting a light source fitting 71. The mounting plate 72 has a slot 73 engagable with the action nuts 67. Such bracket unit may be utilized to provide additional lights projecting either forwardly or rearwardly with respect to either set of wheels.

As should now be evident, the instant invention provides a bracket assembly composed of a number of bracket units which may be selectively utilized to illuminate the skates. The user is given a wide variety of options as to illuminating patterns which may be utilized depending upon the chosen combination of bracket units. Numerous modifications may be made in the configuration of the individual bracket units, as well as the number and location of the light sources. The light sources 13 themselves may comprise various combinations of plain or colored bulbs, and various switching arrangements may be provided to selectively energize various selections of the bulbs. The light sources can also be made by solid state technology instead of using conventional light bulbs. Examples of solid state light sources are minature light emitting diode (LED) lights and liquid crystal display (LCD) lights. In addition to providing toggle switches for controlling illumination of given light sources, mercury switches may be substituted for selected switches which will serve to actuate selected combinations of light sources when the skate is tilted to an essentially upright position. In addition, blinker bulbs may be utilized to provide flashing light sources.

Additionally, the front wheels 7 and the rear wheels 8 can be formed from a transparent or translucent substance so that the illumination from the light sources 13 mounted on the lower bracket unit 11 can pass through the wheels to provide a varied visual effect. Additionally, mechanical centrifugal switches may be installed on the front wheels 7 or rear wheels 8 so that the light sources 13 on the various bracket units will be actuated as the skater obtains a particular velocity while skating. In addition, the wheels or selected portions of the skate frame may be formed from a fluorescent chemical compound so that the skates may glow when being used. In the claims which follow, the term "bracket assembly" is used to define a shoe skate attachment composed of one or more bracket units operatively connected to provide the desired visual imagery.

What is claimed is:

1. A bracket assembly for illuminating a shoe skate having a toe and heel, and an elongated skate frame attached to the toe and heel of the skate shoe, said bracket assembly comprising:

a toe bracket, a lower bracket, and a rear bracket;

attachment means for detachably connecting the bracket frame to the skate frame;

fittings on said brackets for mounting light sources thereon;

means mounted on said brackets for providing electrical energy for said fittings;

switch means mounted on said brackets for actuating the light sources;

wherein said toe bracket surrounds the toe of said skate shoe; and a light transmissive coverture which is attached to said toe bracket and which completely surrounds the toe bracket and the toe of said skate shoe, wherein said light transmissive coverture is spaced above the toe of said skate shoe and houses a light source and a light mounting bracket integral with said toe bracket in said space.

2. The bracket assembly claimed in claim 1 wherein said lower bracket attaches to the skate frame intermediate the front and rear ends thereof.

3. The bracket assembly claimed in claim 1 wherein the fittings for mounting the light sources are integral with said brackets and are of U-shaped configuration with an aperture in one side thereof for receiving the light source.

4. The bracket assembly claimed in claim 3 wherein said brackets are formed from a material which conducts electricity.

5. The bracket assembly claimed in claim 1 wherein the attachment means for detachably connecting the brackets to said skate frame are adapted to be inserted between the skate shoe and the skate frame.

6. The bracket assembly claimed in claim 5 wherein the attachment means for detachably connecting the brackets to the skate frame comprises an integral channel shaped member adapted to enter into clamping engagement with an edge of the skate frame.

7. The bracket assembly claimed in claim 1 wherein the means mounted on said brackets for providing electrical energy for said fittings comprises a housing adapted to be mounted on the skate frame adjacent the heel of the skate shoe, and means in said housing for mounting a source of electrical energy.

8. The bracket assembly claimed in claim 7 wherein said heel is formed from a light transmitting material, wherein the front of the heel has a cavity therein, and wherein a fitting for mounting a light source is formed in said housing and positioned so that the light source will project into said cavity.

9. The bracket assembly claimed in claim 7 assembly includes a rear bracket wherein said rear bracket is integrally formed with said housing.

* * * * *